United States Patent [19]

Wate

[11] Patent Number: 4,876,830

[45] Date of Patent: Oct. 31, 1989

[54] OUTDOOR COVER ASSEMBLY

[76] Inventor: John E. Wate, 755 W. Buno, Milford, Mich. 48042

[21] Appl. No.: 240,618

[22] Filed: Sep. 6, 1988

[51] Int. Cl.[4] ..... E04B 1/344

[52] U.S. Cl. ..... 52/29; 52/66; 52/69

[58] Field of Search ..... 52/69, 36, 64, 68, 66, 52/29; 296/76; 267/64.11, 64.25

[56] References Cited

U.S. PATENT DOCUMENTS

| | | | |
|---|---|---|---|
| 2,284,712 | 6/1942 | Anderson | 52/69 |
| 2,503,378 | 4/1950 | Cornwell | 267/64.25 |
| 2,873,487 | 2/1959 | Blanchard | 52/69 |
| 3,381,421 | 5/1968 | Sicklesteel | 52/36 |
| 4,373,707 | 2/1983 | Molders | 267/64.25 |
| 4,408,751 | 10/1983 | Dodson | 267/64.11 |
| 4,530,412 | 7/1985 | Sigety | 296/76 |
| 4,744,548 | 5/1988 | Hathaway | 296/76 |

*Primary Examiner*—John E. Murtagh
*Attorney, Agent, or Firm*—Krass and Young

[57] ABSTRACT

An outdoor cover assembly for removably covering material positioned on a base surface adjacent a vertical outdoor wall surface. The cover assembly includes a cover structure formed of a single unitary molded fiberglass member and including a top wall, a front wall, side walls, an open back, and an open bottom. Hinge means are provided to mount the rear edge of the top wall of the cover structure at a location on the vertical wall surface at a distance above the base surface approximating the height of the cover structure and a pair of gas struts are provided to assist the cover structure in its movement between a lowered storage position and a raised access position. The struts are attached at their lower ends to bracket members secured to the wall surface proximate the base storage surface and secured at their upper ends to the inboard faces of the respective side walls of the cover structure. The strut assemblies store energy in response to downward movement of the cover structure and assume a position totally within the cover structure and totally concealed by the cover structure with the cover structure in its lowered position. As the cover structure is moved toward its raised access position, a moment arm gradually develops as between the line of action of the strut members and the pivot axis of the cover structure so that the strut assemblies assist in the upward movement of the cover structure.

18 Claims, 3 Drawing Sheets

OUTDOOR COVER ASSEMBLY

BACKGROUND OF THE INVENTION

This invention relates to cover structures or cover assemblies and more particularly to a cover assembly that is especially adapted for use in outdoor storage situations.

It is common practice to store material outside of buildings or generally adjacent the building. Such materials may include, for example, fire wood, garden supplies, recreational equipment or equipment associated with grounds maintenance. Various sheds, bins or the like have been proposed to facilitate such outdoor storage but none of these prior art structures have achieved any significant commercial success because of their initial expense, their limited storage capacity, their maintenance requirements, their unattractive appearance, or the difficulty associated with moving the stored items into and out of the storage structure.

SUMMARY OF THE INVENTION

This invention is directed to the provision of an outdoor cover assembly which is inexpensive to produce, attractive, easily installed, commodious, long lasting, and which provides ready and easy access to the stored items while yet providing excellent weather protection for the stored items.

The invention outdoor cover assembly is adapted to be mounted on an outdoor wall surface of a building for purposes of selectively sheltering items positioned on a base surface adjacent the building outdoor wall surface. The invention cover assembly includes a cover structure including a generally rectangular top wall, a generally rectangular front wall extending downwardly from the front edge of the top wall, and generally rectangular left and right side walls joined at their upper edges to respective side edges of the top wall and at their forward edges to respective side vertical edges of the front wall; hinge means secured to the rearward edge of the top wall and adapted to be secured to the building surface at a height above the base surface generally corresponding to the height of the cover structure so that the cover structure may be pivotally moved about the hinge pivot axis between a lowered storage position in which the lower edges of the side walls and the front wall are resting on the base surface and the rearward edges of the side walls and top wall are adjacent the building surface and a raised access position in which the cover structure extends generally forwardly from the building surface to provides access to the sheltered items; and assist means positioned between cover structure and the wall surface operative to store energy in response to movement of the cover structure from its raised position to its lowered position and operative in response to movement of the cover structure from its lowered position toward its raised position to release the stored energy to assist in the upward movement of the cover structure to its raised position. This arrangement provides a ready and convenient means of providing weather protection for items stored in an outdoor environment while yet providing ready and convenient access to the stored items.

According to a further feature of the invention, the assist means comprises at least one strut assembly adapted to be secured at its lower end to the wall surface at a lower attachment point proximate the base surface and secured at its upper end to the cover structure at an upper attachment point spaced from the hinged pivot axis. This arrangement provides an inexpensive and convenient means of providing the desired assist mechanism.

According to a further feature of the invention, the upper attachment point is adjacent the rearward edge of the one side wall and below the hinge axis. This specific attachment point location facilitates the smooth upward and downward movement of the cover structure.

According to a further feature of the invention, the upper attachment point is nearer the upper edge of the one side wall than the lower edge of the one side wall so as to further optimize the smooth upward and downward movement of the cover structure.

According to a further feature of the invention, two strut assemblies are provided with each strut assembly secured at its lower end to the wall surface and at its upper end to a respective side wall. The two strut assemblies provide balancing for the upward and downward movement of the cover structure.

According to a further feature of the invention, the upper attachment points are located on the inboard face of the respective side wall and the lower attachment points are located directly below the respective upper attachment points and inboard of the respective side walls so that the strut assemblies are completely hidden from view with the cover structure in its lowered position.

According to a further feature of the invention, the attachment points are located such that with the cover structure in its lowered position the hinge axis, the upper attachment point and the lower attachment point lie approximately in a straight line. With this arrangement, a progressively increasing moment arm is developed as the cover structure moves toward its raised position to enable the stored energy to be utilized to assist the raising of the cover structure.

According to a further feature of the invention, each strut assembly comprises a gas strut assembly including a cylinder member, a piston member slidably telescoping within the cylinder member, and a compressible gas positioned within the cylinder so that as the piston member moves telescopically into the cylinder during downward movement of the cover structure, the gas is compressed to store energy which is released during the subsequent upward movement of the cover structure to provide a power assist for the upper movement.

According to a further feature of the invention, the cover assembly further includes a pair of bracket members adapted to be secured to the wall surface and defining pivot attachment means for pivotally attaching the lower end of a respective strut assembly. These bracket members facilitate the ready and positive installation of a cover assembly on the associated outdoor wall surface.

According to a further feature of the invention, the cover assembly further includes a handle secured to the outboard face of the front wall of the cover structure at a location thereon nearer to the lower edge thereof than the top edge thereof. This handle arrangement allows the cover structure to be readily moved from its lowered to its raised positions with a minimum of effort.

According to a further feature of the invention, the cover structure further includes outboardly extending flange portions along the rear and bottom edges of the side walls, the rear edge of the top wall, and the bottom edge of the front wall. These flange portions rigidify the cover structure and form relatively large area seating surfaces for seating engagement against the building wall surface and against the base surface.

According to a further feature of the invention, each strut assembly comprises a double acting strut assembly including a first piston member secured to the upper attachment point, a second piston member secured to the lower attachment point, and a cylinder member telescopically receiving the first and second piston members at its upper and lower ends respectively. This specific strut construction enables the strut assemblies to act effectively to provide the required energy storage and energy release as between two widely spaced attachment points.

According to a further feature of the invention, the cover structure is formed as a single unitary molded member. This arrangement simplifies the construction of the cover assembly, minimizes maintenance of the cover assembly, and provides an attractive appearance for the cover assembly. In the disclosed embodiment of the invention, the cover structure is formed of a suitable fiberglass material.

DETAILED DESCRIPTION OF THE PREFERRED EMBODIMENT

Figure 1:
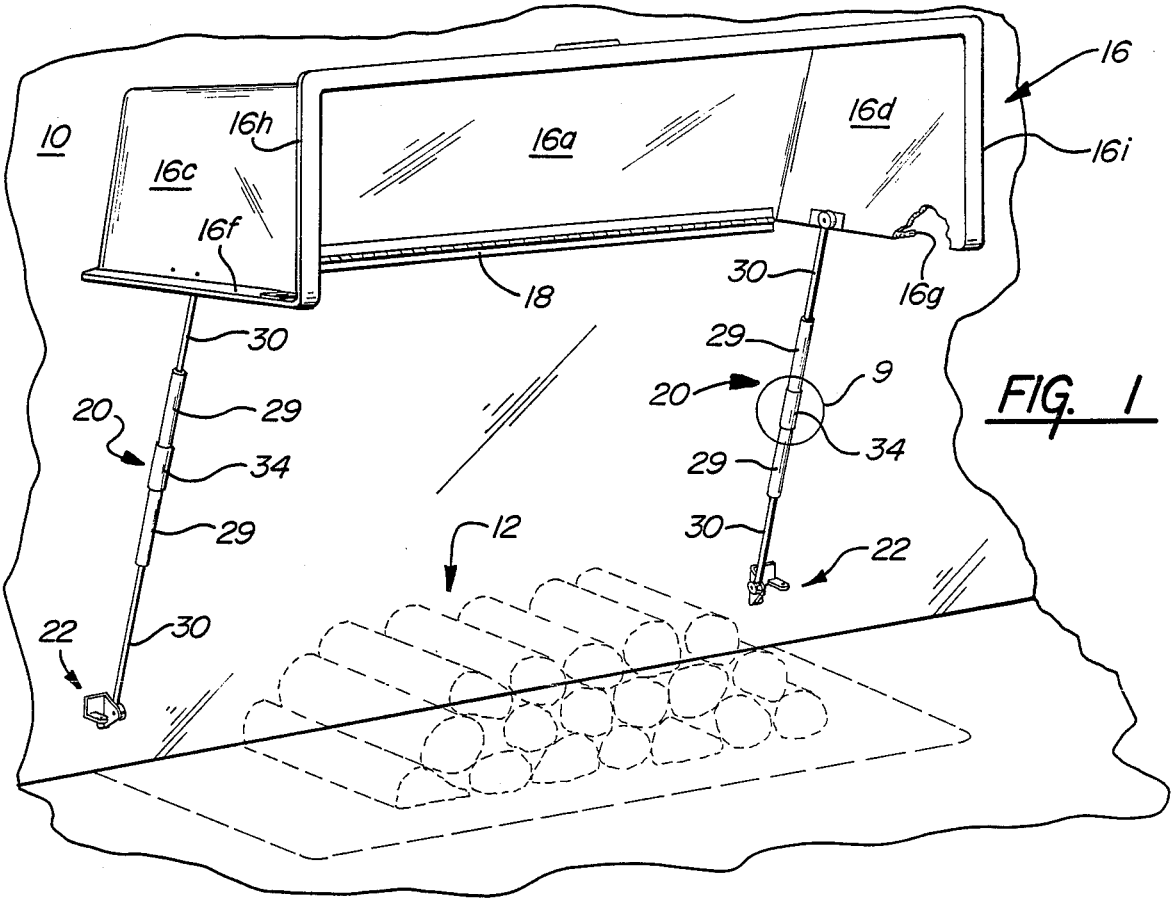
FIG. 1 is a perspective view of the invention cover assembly in a raised, access position.

The invention outdoor cover assembly is adapted to be mounted on an outdoor wall surface 10 of a building for purposes of selectively sheltering items, such for example as cut wood 12, positioned adjacent the surface 10 on a base surface 14. Surface 14 may comprise a natural ground surface or an artificial-surface as concrete.

The invention outdoor cover assembly, broadly considered, comprises a cover structure 16, a hinge structure 18, a pair of strut assemblies 20, and a pair of brackets 22.

Cover structure 16 is preferably formed as a unitary molded member and may be formed for example of a suitable fiberglass material. Cover assembly 16 includes a generally rectangular top wall **16*a* with a slight downward slope; a generally rectangular front wall 16*b* extending downwardly from the front edge of top wall 16*a*, and generally rectangular left and right side walls 16*c* and 16*d* joined at their upper edges to the respective side edges of top wall 16*a* and at their forward edges to respective side vertical edges of front wall 16*b*. An outboardly extending flange portion 16*e* is provided along the rear edge of top wall 16*a*, further outboard flange portions 16*f* and 16*g* are provided along the rear edges of side walls 16*c* and 16*d*, further outboard flange portions 16*h* and 16*i* are provided adjacent the bottom edges of side walls 16*c* and 16*d*, and a further outboard flange portion 16*k* is provided along the bottom edge of front wall 16*a***.

The dimensions of cover structure 16 will of course vary depending upon the particular application envisioned. In a typical installation, intended to cover such items as stored wood, outdoor maintenance equipment, small-wheeled vehicles, or cycles, the cover structure might have a height of five feet, a width of eight feet and a depth of two feet.

Figure 2:
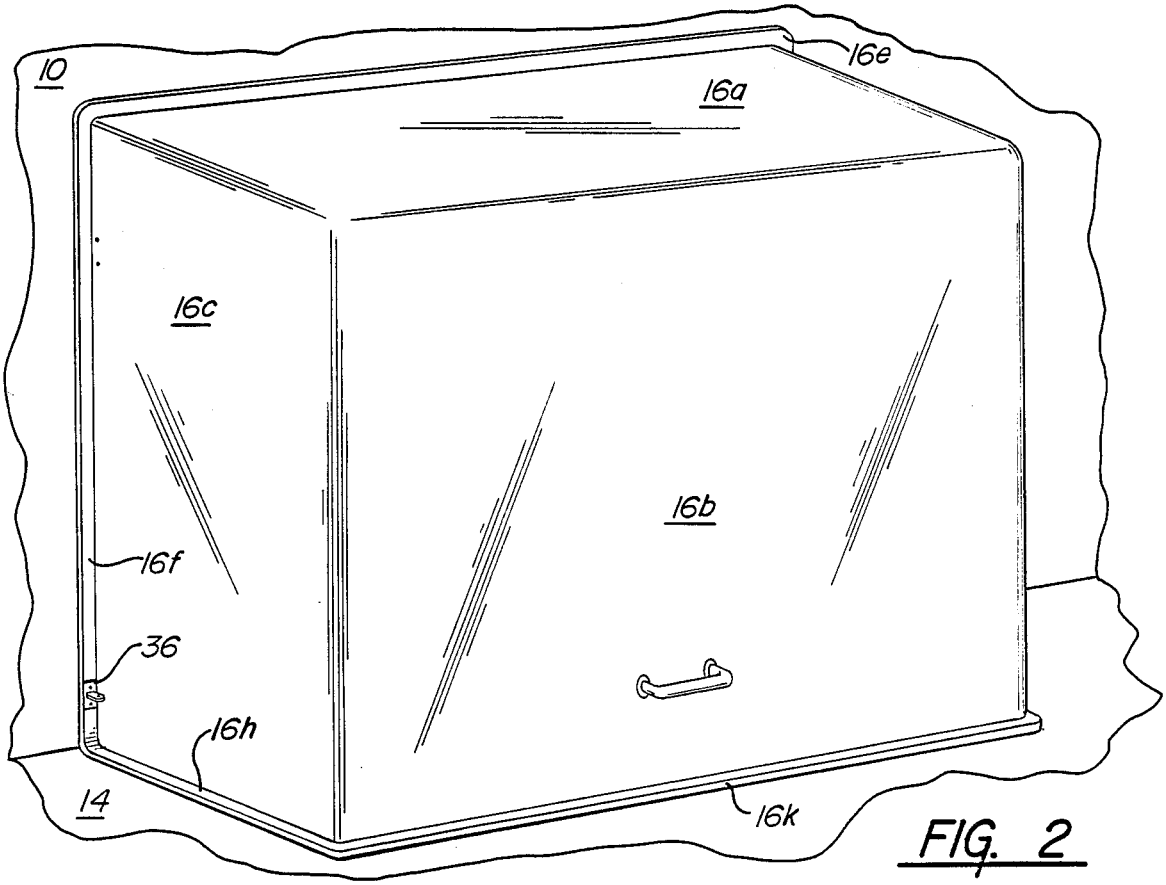
FIG. 2 is a perspective view of the invention cover assembly is a lowered, storage position.
Figures 4, 8, 9:
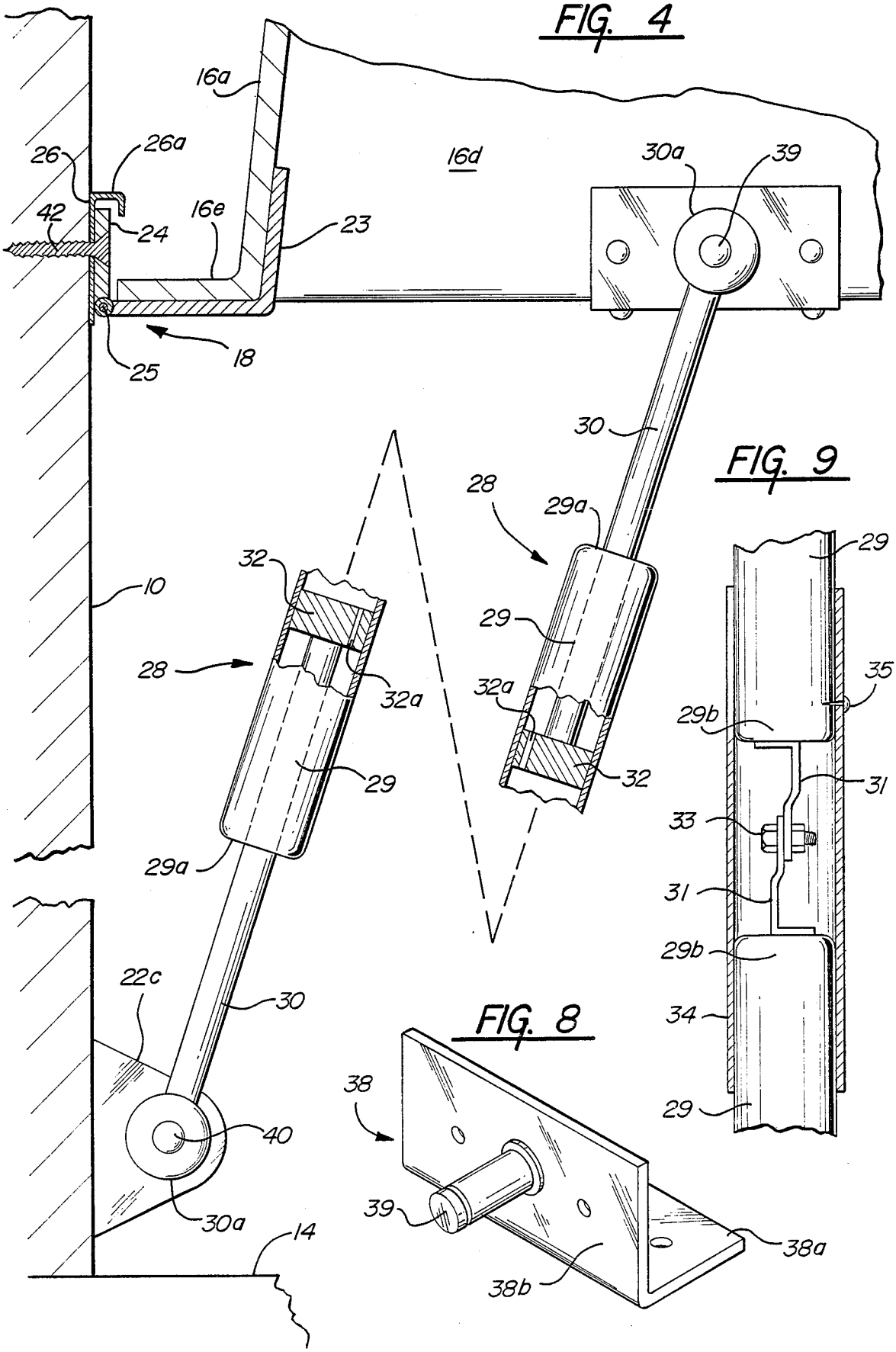
FIG. 4 is a fragmentary cross-sectional view of the invention storage assembly in its raised, access position.
FIG. 8 is a detail view of a mounting plate utilized in the invention cover assembly.
FIG. 9 is a detail view taken within the circle 9 of FIG. 1.
Figure 3:
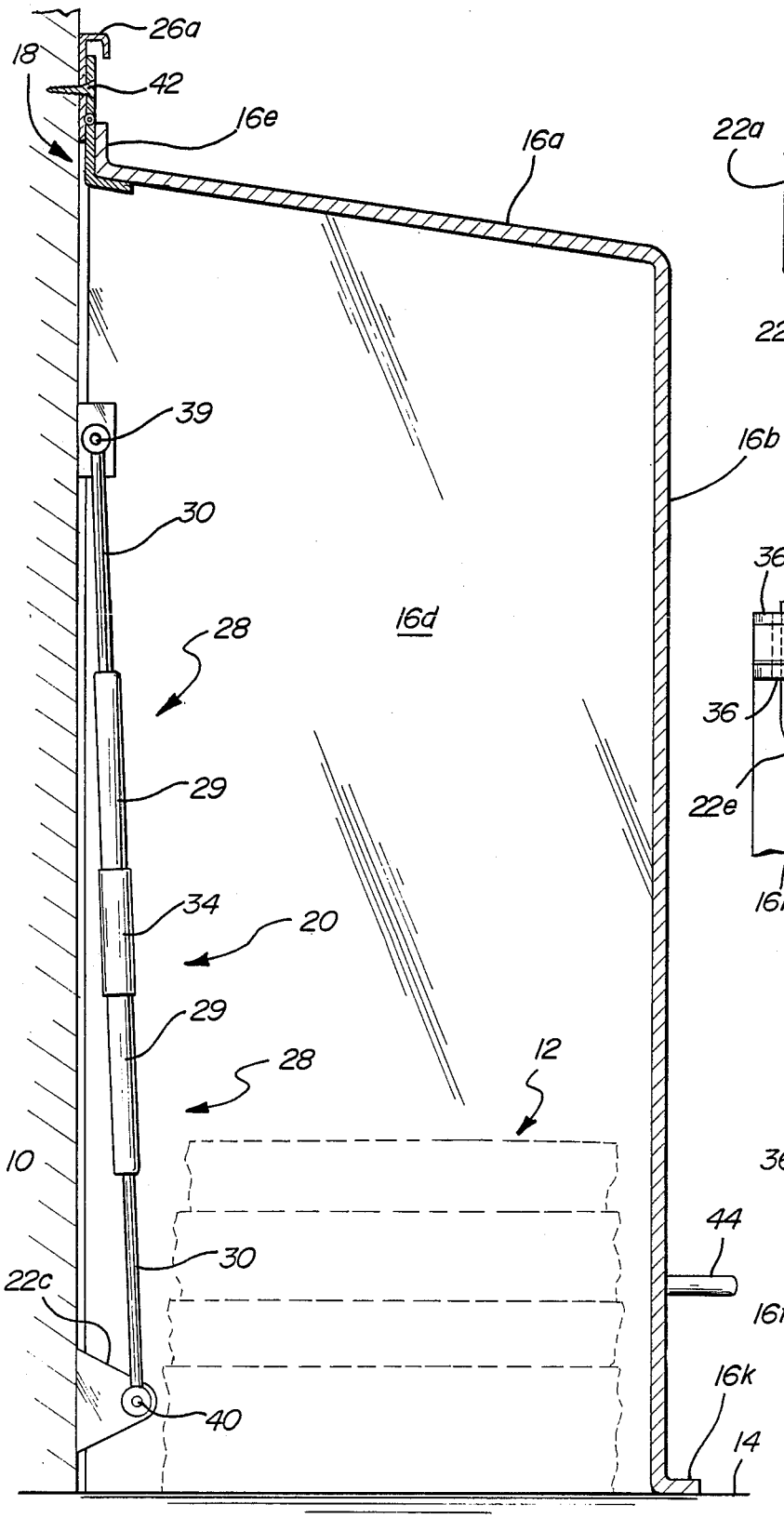
FIG. 3 is a cross-sectional view of the invention storage assembly shown in a lowered storage position.

Hinge assembly 18 may take any of various forms but preferably is of the piano hinge type. Hinge assembly 18, as best seen in FIG. 4, may include a first hinge structure in the form of an angle member 23 suitably secured to the rear edge of the upper wall **16*a* of the cover structure and a hinge plate 24 suitably secured to the building wall surface 10 at a height above the base surface 14 generally corresponding to the height of the cover structure. Members 23 and 24, in known manner, define inter nesting hinge portions which receive a hinge pin 25 so as to mount the cover assembly for pivotal movement about the axis of pin 25 between a raised, access position and a lowered, storage position. The raised, access position is seen in FIGS. 1 and 4 and the lowered storage position is seen in FIGS. 2 and 3. In the lowered, storage position, the lower edges of wall 16*c*, 16*b* and 16*d* rest on base surface 14 with flange portion 16*h*, 16*k* and 16*g* providing wide area seating surfaces as between the lower edges of the cover structure and the base surface, and the rear edges of walls 16*c*, 16*a* and 16*d* are disposed adjacent building surface 10 with flange portion 16*f*, 16*e* and 16*g* again providing wide area seating surfaces as between the cover structure and the wall surface 10. A vinyl J channel 26 may be positioned between hinge plate 24 and wall surface 10 to position the hook portion 26*a*** of the vinyl channel in umbrella fashion over the hinge assembly for weather protection purposes.

Each strut assembly 20 is preferably a double acting gas strut assembly formed by placing two gas struts or springs 28 in back to back relationship. Struts 28 may be of the type available for example from Tokico America Inc. of Torrance, Calif. as gas spring Part No. Y2096. Each strut 28 includes a cylinder 29 containing compressed nitrogen gas, a piston rod 30 passing sealingly through one end **29*a* of the cylinder, a mounting bracket 31 welded to the other end 29*b* of the cylinder and a piston 32 slidably mounted in cylinder 29 and including a valve opening 32*a*** to allow controlled movement of the compressed nitrogen gas from one side to the other of the piston during the contraction and expansion of the strut.

The back to back struts 28 are secured together by a bolt 33 passing through aligned apertures in mounting brackets 31 and by a metal sleeve 34 fitted over the ends **29*b* of the cylinders and held in place by a set screw 35**.

Figure 5:
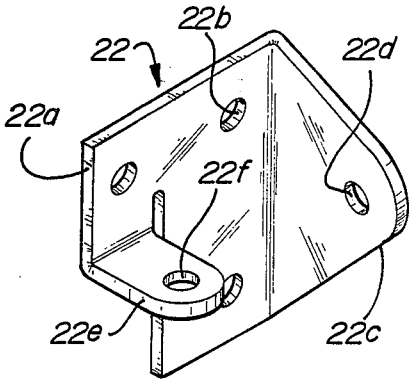
FIG. 5 is a perspective view of a mounting bracket utilized in the invention cover assembly.
Figure 7:
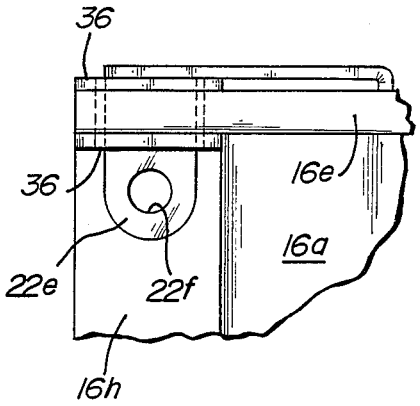
FIGS. 6 and 7 are detail views showing a locking mechanism for the cover assembly.
Figure 6:
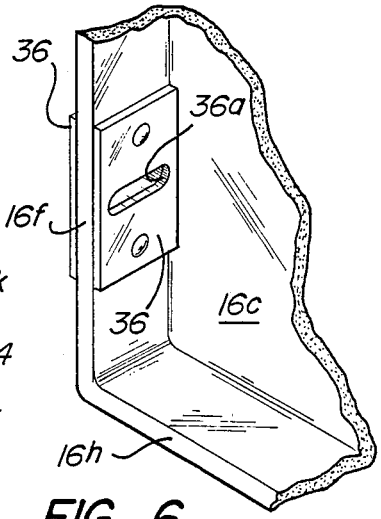

Bracket members 22 may take any of several convenient forms. Each bracket may, for example, as seen in FIG. 5, include a base portion **22*a* including apertures 22*b*, an ear or flange portion 22*c* having an aperture 22*d*, and a hasp portion 22*e* having an aperture 22*f***.

A pair of metal hasp plates 36 are riveted to opposite faces of cover structure flange portion **16*f* proximate flange portion 16*h* and a further pair of metal hasp plates 36 are riveted to opposite faces of cover structure flange portion 16*g* proximate flange portion 16*i*. Hasp plates 36 have hasp slots 36a** aligned with a hasp slot in the respective cover structure flange portion.

A mounting angle bracket 38 is secured to each cover structure side wall 16c, 16d in proximate but spaced relation to hinge assembly 18. Each bracket 38 includes a first portion 38a riveted to the underface of the respective flange portion 16f, 16g of the cover structure and a second portion 38b riveted to the inboard face of the respective cover structure side walls 16c, 16d. A pivot pin 39 is rigidly secured to the portion 38b of each bracket 38.

In the assembled relation of parts, brackets 22 are secured to wall surface 10 adjacent base surface 14 by suitable fastener members passing through apertures 22b in the base portions 22a of the bracket members; the eye portion 30a on each lower piston rod 30 is pivotally mounted on a mounting bracket ear portion 33c by a pivot pin 40 received in aperture 22d; the eye portion 30a on each upper piston rod 30 is mounted on a respective pivot pin 39 in a position adjacent the inboard face of a respective side wall 16c, 16d; and the cover assembly is secured to the wall surface 10 by suitable fasteners 42 passing through hinge plate 24 for engagement with the building defining the surface 10. The point of pivotal attachment of the upper ends of the upper piston rods 30 as defined by the pins 39 is adjacent the rear edges of the respective side walls 16c and 16d and is substantially closer to the pivot axis defined by the hinge assembly 18 than to the lower edge of the side walls 16c,16d. Preferably, as best seen in FIG. 3, with the cover structure in its lowered, storage position, the pivot axis defined by the hinge pin 25 of hinge structure 18, the pivotal upper connection points defined by the pins 39, and the lower pivot axes defined by the pins 40 lie substantially in a straight line so that the stored energy within the strut assemblies 20 acts along a line of action passing through the pivot axis of the hinge pin 25 so as to have no tendency to move the cover structure toward its raised access position. The cover structure is thus maintained in its lowered storage position by its own weight. When it is desired to move the cover structure to its raised, access position, a handle 44 provided on the outboard face of the cover structure front wall 16b proximate the lower edge of the front wall is grasped and an upward pull is inserted on the handle 44 to pivot the cover structure about the pivot axis of hinge structure 18 toward its raised, access position. As the cover structure moves toward its raised, access position, the pivotal attachment points defined by the pins 39 move out of alignment with the pivot axed defined by lower pins 40 and the hinge pin 25 so that a moment arm relative to the axis of hinge pin 25 progressively develops as the cover structure moves toward its raised position. The progressively increasing moment arm Whereas a preferred embodiment of the invention has been illustrated and described in detail, it will be apparent that various changes may be made in the disclosed embodiment without departing from the scope or spirit of the invention.

I claim:

1. An cover assembly adapted to be mounted on a wall surface for purposes of selectively sheltering items positioned adjacent the wall surface on a base surface, said cover assembly comprising:

(A) a cover structure including (1) a top wall;

(2) a front wall extending downwardly from the front edge of said top wall, and (3) left and right side walls joined at their upper edges to respective side edges of said top wall and at their forward edges to respective side vertical edges of said front wall;

(B) hinge means secured to the rearward edge of said top wall and adapted to be secured to said wall surface at a height above the base surface generally corresponding to the height of the cover structure so that the cover structure may be pivotally moved about the hinge pivot axis between a lowered storage position in which the lower edges of the side walls and the front wall are resting on the base surface and the rearward edges of the side walls and top wall are adjacent the building surface, and a raised access position in which the cover structure extends generally forwardly from the building surface to provide access to the sheltered items; and (C) assist means positioned between said cover structure and the wall surface operative to store energy in response to movement of said cover structure from its raised position to its lowered position and operative in response to movement of said cover structure from its lowered position toward its raised position to release said stored energy to assist in the upward movement of said cover structure to its raised position;

(D) said assist means comprising at least one strut assembly adapted to be secured at its lower end to the wall surface at a lower attachment point between said pivot axis and the base surface and secured at its upper end to said cover structure at an upper attachment point spaced from said hinge pivot axis and positioned, with said cover member in its lowered position, adjacent the rearward edge of said one side wall and below said hinge axis.

2. A cover assembly according to claim 1, wherein (E) said upper attachment point, with said cover in its lowered position, is nearer the upper edge of said one side wall than the lower edge of said one side wall.

3. A assembly according to claim 2 wherein:

(G) two strut assemblies are provided with each strut assembly secured at its lower end to the wall surface and at its upper end to a respective side wall.

4. A cover assembly according to claim 2 wherein:

(G) said strut assembly comprises a gas strut assembly including a cylinder, a piston assembly slidably telescoping within the cylinder, and a compressible gas positioned within said cylinder so that as said piston assembly moves telescopically into said cylinder during downward movement of said cover structure the gas is compressed to store energy which is released during the subsequent upward movement of the cover structure to provide a power assist for the upward movement.

5. An outdoor cover assembly according to claim 4 wherein:

(H) said strut assembly comprises a double acting gas strut assembly including a first piston assembly secured to the upper attachment point, a second piston assembly secured to the lower attachment point, and cylinder means telescopically receiving said first and second piston assemblies at its upper and lower ends respectively.

6. An cover assembly adapted to be mounted on a wall surface for purposes of selectively sheltering items positioned adjacent the wall surface on a base surface, said cover assembly comprising:

(A) a cover structure including;
(1) a top wall,
(2) a front wall extending downwardly from the front edge of said top wall, and
(3) left and right side walls joined at their upper edges to respective side edges of said top wall and at their forward edges to respective side vertical edges of said front wall, (B) hinge means secured to the rearward edge of said top wall and adapted to be secured to said wall surface at a height above the base surface generally corresponding to the height of the cover structure so that the cover structure may be pivotally moved about the hinge pivot axis between a lowered storage position in which the lower edges of the side walls and the front wall are resting on the base surface and the rearward edges of the side walls and top wall are adjacent the building surface, and a raised access position in which the cover structure extends generally forwardly from the building surface to provide access to the sheltered items; and (C) assist means positioned between said cover structure and the wall surface operative to store energy in response to movement of said cover structure from its raised position to its lowered position and operative in response to movement of said cover structure from its lowered position toward its raised position to release said stored energy to assist in the upward movement of said cover structure to its raised position;

(D) said assist means comprising at least one strut assembly adapted to be secured at its lower end to the wall surface at a lower attachment point between said pivot axis and the base surface and secured at its upper end to said cover structure at an upper attachment point spaced from said hinge point axis;

(E) said upper attachment point being located on the inboard face of one of said side walls and said lower attachment point being located substantially directly below said upper attachment point and, with said cover structure in its lowered position, inboard of said one side wall so that said strut assembly is completely hidden from view within said cover structure with said cover structure in its lowered position.

7. An outdoor cover assembly according to claim 6 wherein:

(F) said cover assembly further includes a pair of bracket members adapted to be secured to the wall surface and defining pivot attachment means for pivotally attaching the lower ends of respective strut assemblies.

8. An outdoor cover assembly according to claim 7 wherein:

(J) said cover assembly further includes a handle secured to the outboard face of said front wall of said cover structure at a location thereon nearer the lower edge thereof than the top edge thereof.

9. An cover assembly adapted to be mounted on a wall surface for purposes of selectively sheltering items positioned adjacent the wall surface on a base surface, said cover assembly comprising:

(A) a cover structure including;
(1) a top wall,
(2) a front wall extending downwardly from the front edge of said top wall, and
(3) left and right side walls joined at their upper edges to respective side edges of said top wall and at their forward edges to respective side vertical edges of said front wall, (B) hinge means secured to the rearward edge of said top wall and adapted to be secured to said wall surface at a height above the base surface generally corresponding to the height of the cover structure so that the cover structure may be pivotally moved about the hinge pivot axis between a lowered storage position in which the lower edges of the side walls and the front wall are resting on the base surface and the rearward edges of the side walls and top wall are adjacent the building surface, and a raised access position in which the cover structure extends generally forwardly from the building surface to provide access to the sheltered items; and (C) assist means positioned between said cover structure and the wall surface operative to store energy in response to movement of said cover structure from its raised position to its lowered position and operative in response to movement of said cover structure from its lowered position toward its raised position to release said stored energy to assist in the upward movement of said cover structure to its raised position;

(D) said assist means comprising at least one strut assembly adapted to be secured at its lower end to the wall surface at a lower attachment point between said pivot axis and the base surface and secure at its upper end to said cover structure at an upper attachment point spaced from said hinge point axis;

(E) said attachment points being located such that with said cover structure in its lowered position, said hinge axis, said upper attachment point, and said lower attachment point lie approximately in a straight line, whereby a progressively increasing moment arm is developed as said cover structure moves toward its raised position to enable stored energy to be utilized to assist the raising of the cover structure.

10. An cover assembly adapted to be mounted on a wall surface for purposes of selectively sheltering items positioned adjacent the wall surface on a base surface, said cover assembly comprising:

(A) a cover structure including;
(1) a top wall,
(2) a front wall extending downwardly from the front edge of said top wall, and
(3) left and right side walls joined at their upper edges to respective side edges of said top wall and at their forward edges to respective side vertical edges of said front wall, (B) hinge means secured to the rearward edge of said top wall and adapted to be secured to said wall surface at a height above the base surface generally corresponding to the height of the cover structure so that the cover structure may be pivotally moved about the hinge pivot axis between a lowered storage position in which the lower edges of the side walls and the front wall are resting on the base surface and the rearward edges of the side walls and top wall are adjacent the building surface, and a raised access position in which the cover structure extends generally forwardly from the building surface to provide access to the sheltered items; and (C) assist means positioned between said cover structure and the wall surface operative to stored energy in response to movement of said cover structure from its raised position to its lowered position and operative in response to movement of said cover structure from its lowered position toward its raised position to release said stored energy to assist in the upward movement of said cover structure to its raised position;

(D) said cover structure further including outboardly extending flange portions along the rear edges and bottom edges of said side walls, the rear edge of said top wall and the bottom edge of said front wall, whereby to rigidify the cover structure and form relatively large area seating surfaces for seating engagement against the building wall surface and against the base surface with the cover structure in its lowered storage position.

11. An outdoor cover assembly according to claim 10 wherein:

(D) said cover structure is formed as a single unitary molded member.

12. An outdoor cover assembly according to claim 11 wherein:

(E) said cover structure is formed of fiberglass.

13. A cover assembly for removably covering material positioned on a base surface adjacent a vertical wall surface, said assembly comprising:

(A) a cover structure formed as a single unitary molded piece and including a top wall, a front wall, side walls, an open back, and an open bottom;

(B) hinge means on the rear edge of said top wall adapted to mount said cover structure at a location on the vertical wall surface at a distance above the base surface approximating the height of the cover structure for pivotal movement about a pivot axis between a lowered, storage position in which the lower edges of said side walls and said front wall are supported on the base surface in covering relation to the material disposed on the base surface and a raised, access position in which the cover structure is pivoted upwardly to provide access to the stored material; and (C) a pair of strut assemblies adapted to be pivotally mounted at their lower ends to the wall surface at a location between the base surface and said pivot axis, pivotally secured at their respective upper ends to a respective side wall at a location thereon spaced from said pivot axis, and including energy storage means operative to store energy in response to pivotal movement of said cover structure from its raised to its lower position and release energy to assist the movement of said cover structure from its lowered to its raised position;

(D) said strut assemblies being secured at their upper ends to the inboard faces of the respective side walls and secured at their lower ends substantially directly below their upper ends so as to be enclosed within said cover structure with said cover structure in its lowered position.

14. A cover assembly according to claim 13 wherein:

(D) said strut assemblies are secured to their upper ends to the inboard faces of the respective side walls and secured at their lower end substantially directly below their upper ends so as to be enclosed within said cover structure with said cover structure in its lowered position.

15. A cover assembly according to claim 13 wherein:

(E) each strut assembly comprises a gas strut.

16. A cover assembly according to claim 15 wherein:

(F) each strut assembly comprises a double acting gas strut with a central cylinder means and upper and lower piston assemblies telescopically coacting respectively with the upper and lower ends of the cylinder means.

17. A cover assembly according to claim 15 wherein:

(F) said assembly further includes a handle on the outboard face of said front wall at a location thereon proximate the lower edge thereof.

18. A cover assembly according to claim 13 wherein:

(E) the upper and lower pivotal attachment points of each strut assembly lie in substantially a straight line with said pivot axis with said cover structure in its lowered position.

* * * * *